United States Patent [19]

Barr

[11] Patent Number: 4,688,715

[45] **Date of Patent: * Aug. 25, 1987**

[54] TWO-WAY MAILING ENVELOPE AND METHOD OF MAKING AND ADDRESSING THE SAME

[76] Inventor: Arthur C. Barr, 1714 Yahara Pl., Madison, Wis. 53704

[ * ] Notice: The portion of the term of this patent subsequent to Jul. 29, 2003 has been disclaimed.

[21] Appl. No.: 845,947

[22] Filed: Mar. 31, 1986

Related U.S. Application Data

[63] Continuation-in-part of Ser. No. 703,792, Feb. 21, 1985, Pat. No. 4,602,736.

[51] Int. Cl.[4] ..... B65D 27/06

[52] U.S. Cl. ..... 229/73; 493/188

[58] Field of Search ..... 229/73; 493/188

[56] References Cited

U.S. PATENT DOCUMENTS

| | | | |
|---|---|---|---|
| 690,500 | 1/1902 | West . | |
| 1,064,302 | 6/1913 | Donohue . | |
| 1,373,512 | 4/1921 | Kuhhorn . | |
| 2,201,538 | 5/1940 | Holden . | |
| 2,527,925 | 10/1950 | Frampton . | |
| 2,695,130 | 11/1954 | Covan | 229/73 |
| 2,941,711 | 6/1960 | Biek | 229/73 |
| 3,113,716 | 12/1963 | Howard | 229/73 |
| 3,270,948 | 9/1966 | Donovan . | |
| 3,356,285 | 12/1967 | Greason . | |
| 3,411,699 | 11/1968 | Pine et al. | 229/73 |
| 3,558,040 | 1/1971 | Krueger . | |
| 4,308,987 | 1/1982 | Solomon . | |
| 4,332,346 | 6/1982 | Kronman . | |
| 4,334,618 | 6/1982 | Buescher | 229/73 |
| 4,382,539 | 5/1983 | Kronman . | |
| 4,445,635 | 5/1984 | Barr . | |

*Primary Examiner*—Stephen P. Garbe

*Attorney, Agent, or Firm*—Vernon J. Pillote

[57] ABSTRACT

A two-way mailing envelope formed from a single blank having generally rectangular front and rear panels integrally joined together along an upper panel fold line. A first closure flap is integrally joined along a first flap fold line to the lower edge of the front panel. The rear panel is shorter than the front panel and a second closure flap integrally joined along a second flap fold line to the lower edge of the rear panel. Mailing address indicia are provided on the front side of the envelope in a mailing address read area and oriented to be right side up when the panel fold line is at the top. Return address indicia are provided on the front side of the envelope and oriented to be right side up when the panel fold line is at the top. During the initial mailing, the second closure flap is tucked into the envelope and the first closure flap on the lower edge of the front panel is folded upwardly and sealed to the rear panel of the envelope. The envelope is opened at the first flap and the envelope is resealed for return mailing by folding the second closure flap on the rear panel upwardly and sealing the same against the front panel. The return address indicia is applied to the front of the envelope at a location such that at least the lowermost line of the return address extends into the mailing address read area during return mailing, and the second closure flap is dimensioned so that it covers the original mailing address but leaves the return address indicia exposed for sensing by automatic mail processing equipment during return mailing.

11 Claims, 10 Drawing Figures

TWO-WAY MAILING ENVELOPE AND METHOD OF MAKING AND ADDRESSING THE SAME

This application is a continuation-in-part of my application Ser. No. 06/703,792, filed Feb. 21, 1985 entitled "Two-Way Mailing Envelope" now U.S. Pat. No. 4,602,736 issued July 29, 1986.

BACKGROUND OF THE INVENTION

Present automatic mail processing machinery have optical character readers which can read certain address indicia printed in a preselected mailing address read area on the front of an envelope. The mailing address read area has an upper read area limit spaced a preselected distance above the lower edge of the envelope, and the upper read area limit, even on minimum size envelopes, is spaced a substantial distance below the upper edge of the envelope to allow an upper area on the front of the envelope for a return address and for postage. After the optical character reader has read the mailing address, it will print a bar code representing at least the zip code in a bar code read area on the front of the envelope, which bar code read area is below the mailing address read area and extends along the lower right edge of the envelope a preselected height and width. The bar code printed by the optical character reader is used in bar code sorters and the like in further automated processing of the mail.

It is known to provide two-way or re-mailable mailing envelopes. Some two-way envelopes such as disclosed in U.S. Pat. Nos. 690,500; 1,373,512; 3,270,948; 3,558,040 and 4,445,635, provide envelopes with a short flap on the upper edge of the front panel of the envelope adapted to be folded over and sealed to the rear panel of the envelope in the first mailing of the envelope, and a short flap on the upper edge of the rear panel of the envelope adaped to be folded over and sealed to the front panel on the envelope for re-mailing. The short re-mailing flap on such envelopes only covers the upper return address and postage area on the front of the envelope. Difficulties are encountered if such envelopes are processed during return mailing by automatic mail processing machines since the original mailing address and any bar code applied to the envelope by optical character readers during the initial mailing, remains exposed on the front of the envelope. Some other two-way envelopes such as disclosed in U.S. Pat. Nos. 1,064,302; 4,308,987; 4,332,346 and 4,382,539 provide envelopes with a short flap on the upper edge of one of the side panels of the envelope and a long flap on the upper edge of the other of the side panels of the envelope, with the large flap being dimensioned to substantially cover a side panel of the envelope when it is folded thereover. Still other two-way envelopes such as shown in U.S. Pat. Nos. 2,201,538 and 2,527,925 provide a closed flap on only the lower edge of the rear panel of the envelope. The closure flap is tucked into the envelope during the first mailing and is dimensioned to cover that front panel of the envelope and the addresses thereon during return mailing. Use of large flaps sufficient to cover the entire side of an envelope substantially increases the amount of material required to produce the re-mailable envelope. Further, when the large flap is used as the return mailing closure flap, it must be tucked into the envelope pocket during the initial mailing. If the large return flap is tucked into the envelope pocket in an unfolded condition, it is difficult to withdraw from the envelope pocket for use in re-mailing. The large return flaps are sometimes folded upon themselves and inserted into the pocket in the envelope. While this facilitates withdrawal of a return flap from the pocket, it presents some difficulties during insertion of enclosures into the envelope particularly by automatic insertion machines prior to the original mailing.

In two-way mailing envelopes of the type which have a return flap tucked into the envelope pocket during the first mailing, some problems have been encountered in cutting or otherwise damaging the return flap during opening of the envelope by the original addressee. In some prior two-way mailing envelopes, for example disclosed in U.S. Pat. Nos. 1,064,302 and 3,558,040, the front panel was made higher than the rear panel so that it could be torn off or cut off without damaging the return flap.

SUMMARY OF THE INVENTION

It is an object of the present invention to provide a two-way mailing envelope and method of making and addressing the same which overcomes the above disadvantages of prior two-way mailing envelopes and which minimizes the amount of paper stock required for making the envelope, and which can be processed in automatic mail processing machines during the initial mailing and also during the return mailing.

Accordingly, the present invention provides a two-way mailing envelope and method of making and addressing the same adapted for either manual processing or automatic processing by mail processing machinery having optical character readers which can read address indicia in a preset mailing address read area on the front of the envelope and print a bar code on a bar code read area on the front of the envelope below the mailing address read area. The mailing address read area on the envelope has an upper read area limit spaced a preset height above the lower edge of the envelope and also spaced below the upper edge of the envelope to provide an upper area on the front of the envelope for a return address and for postage.

The two-way mailing envelope is formed from a single elongated blank comprising a generally rectangular front panel having upper and lower side edges and end edges extending between its side edges and a generally rectangular rear panel having upper and lower side edges and end edges extending between its side edges, the front and rear panels being integrally joined at their upper side edges along a panel fold line. A first closure flap is integrally joined of the lower side edge of the front panel along a first flap fold line and a second closure flap is integrally joined to the lower side edge of the rear panel along a second flap fold line, and end flap means connects the front and rear panels together along their end edges to form a pocket. The second closure flap is initially folded along the second flap line relative to the rear panel and inserted into the envelope pocket between the front and rear panels. The first closure flap is adapted to be folded along the first flap fold line relative to the front panel upwardly into overlapping relation with a lower portion of the rear panel and has first flap seal means for sealing the first closure flap to the rear panel for a first mailing of the envelope. The first flap fold line is spaced a first distance below the panel fold line and defines a first envelope lower edge during the first mailing. The second closure flap is removable from the envelope pocket after the envelope is opened and the second closure flap is adapted to be folded along the second flap fold line relative to the rear panel upwardly into overlapping relation with a lower portion of the front panel and has second flap seal means for sealing the second closure flap to the front panel of the envelope for a return mailing of the envelope. The second closure flap is spaced below the panel fold line a second distance less than said first distance and defines a second envelope lower edge during said return mailing. The second closure flap is shaped and dimensioned such that, when folded upwardly along the second flap fold line into overlapping relation to the lower portion of the front panel for the return mailing, at least a portion of its upper free edge is spaced above the second flap fold line a distance less than said preset height of the upper read area limit of said preset OCR mailing address read area. Printed OCR readable return address indicia are applied on the front panel prior to the first mailing and oriented to be right side up for visual and optical character reading when the envelope is oriented with the panel fold line at the top of the envelope. The return address indicia is located on the front panel such that the lowermost line containing the city, state and zip code of the return address is below the upper read area limit of said preset OCR mailing address read area and above said portion of the free upper edge of the second closure flap when the latter is folded upwardly along the second flap fold line into overlapping relation with the lower portion of the front panel for the second mailing. The return address indicia also includes a return name and return delivery address in lines located above the upper read area limit of the preset OCR mailing address read area. Printed OCR readable mailing address indicia are applied on the front panel prior to the first mailing in said preset OCR mailing address read area and oriented to be right side up for visual and optical character reading when the envelope is oriented with the panel fold line at the top of the envelope. The mailing address indicia includes at least the mailing addressee's name, delivery address and city, state and zip code, with the city, state and zip code in the lowermost line of the mailing address. The second closure flap is shaped and dimensioned such that, when folded upwardly along the second flap fold line into overlapping relation to the lower portion of the front panel for the second mailing, it covers the bar code read area on the front panel and all of the mailing address indicia in the preset OCR read area on the front panel but has said portion of the free upper edge of the second closure flap disposed below the lowermost line of the return address indicia whereby all of the return address indicia remains exposed for use in manual or automatic processing during the second mailing.

Since the lowermost line of the original return address remains exposed and lies in the OCR read area during re-mailing, it is not necessary to provide a return address on the second closure flap in order to effect return mailing of the envelope to the original return address. If there is no OCR readable address indicia on the second flap during return mailing, the OCR readers will automatically read the lowermost line of the original return address that extends into the OCR read area and print a bar code on the second flap representing at least the zip code of the original return address for further automated processing of the mail. Thus, the envelope can be completely formed with the second closure flap tucked into the pocket of the envelope, before applying any address indicia to the envelope. The preformed envelope can thereafter be printed with the appropriate return address indicia in the prescribed location on the envelope and addressed for the initial mailing.

The second flap fold line which defines the lower edge of the envelope during the second mailing is spaced below the upper panel fold line a distance less than that first flap fold line which defines the lower edge of the envelope during the first mailing. Thus, during return mailing, the return address is in effect shifted downwardly to extend deeper into the OCR read area and this aids in assuring proper reading of the return address by the OCR reader during return mailing. Similarly, the original mailing address on the front of the envelope is relatively closer to the lower edge of the envelope during return mailing than during the first mailing, and this facilitates covering of the original mailing address with a return flap that has a height less than the height of the upper limit of the OCR reader area.

DETAILED DESCRIPTION

Figure 2:
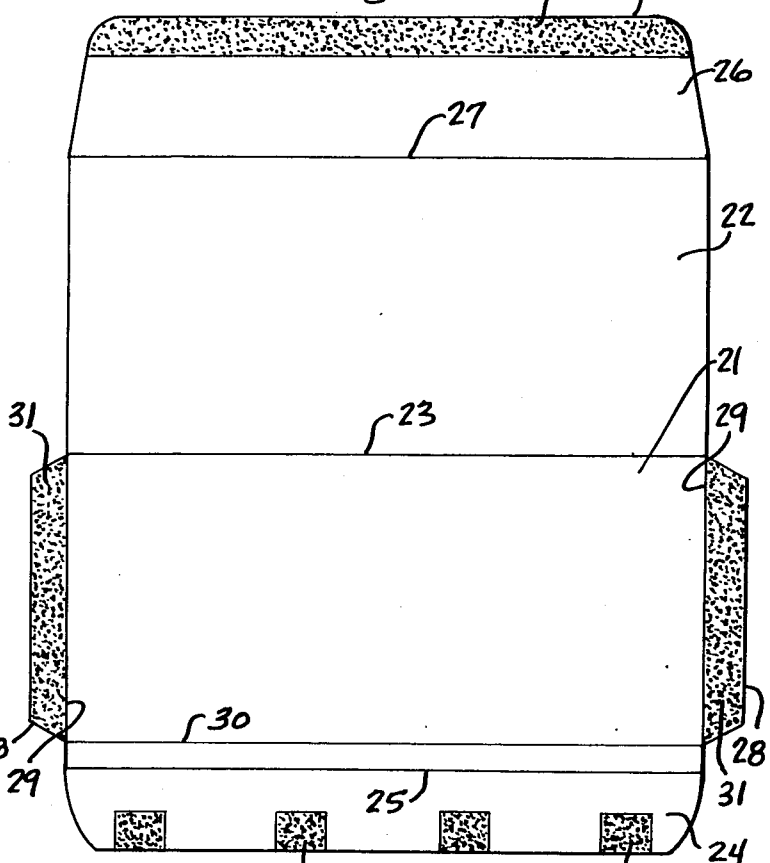
FIG. 2 is a plan view of the inner face of the two-way mailing envelope blank.
Figure 1:
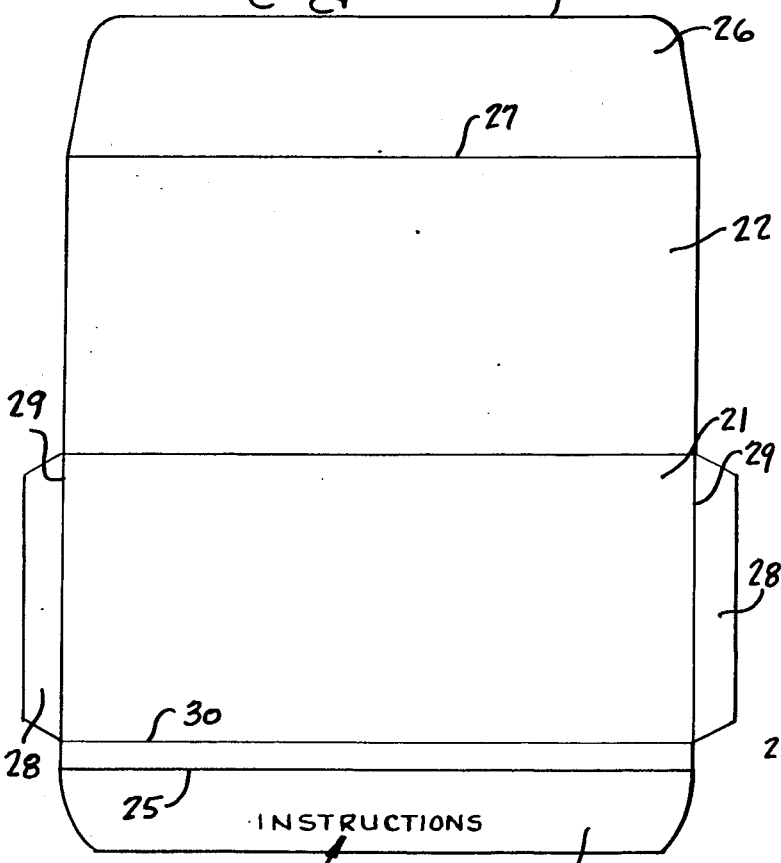
FIG. 1 is a plan view of the outer face of a two-way mailing envelope blank.
Figure 4:
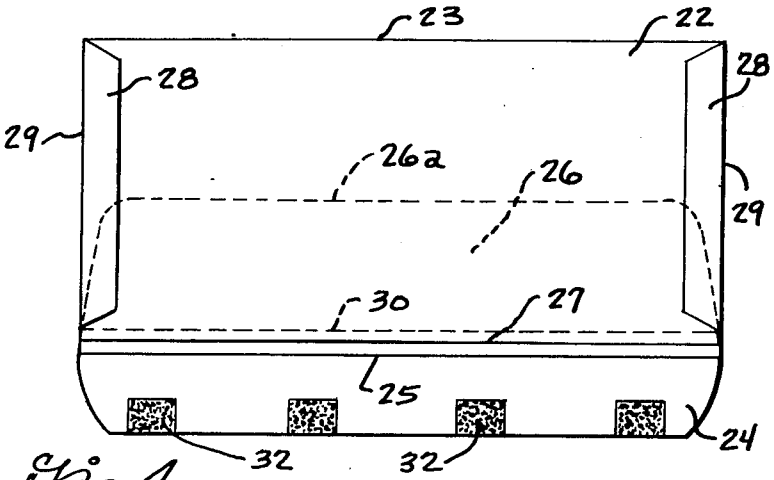
FIG. 4 is a rear view of the open re-mailable envelope shown in FIG. 3.
Figure 3:
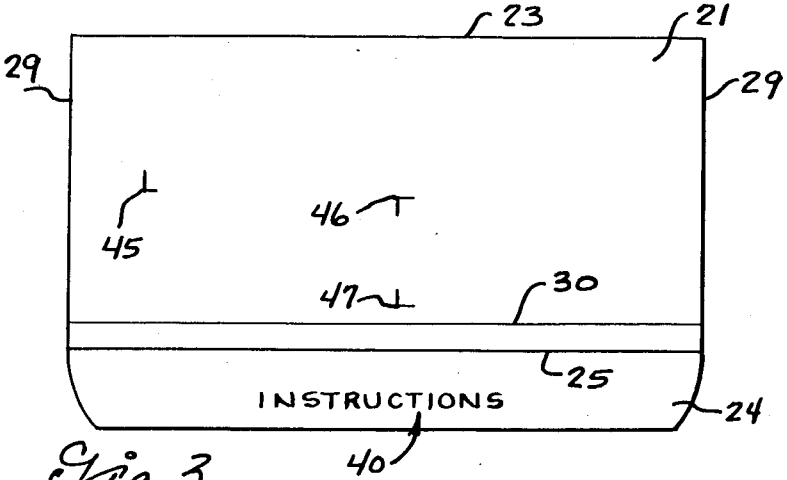
FIG. 3 is a front view of a re-mailable envelope formed from the blank shown in FIGS. 1 and 2 in an open condition for receiving enclosures.
Figure 6:
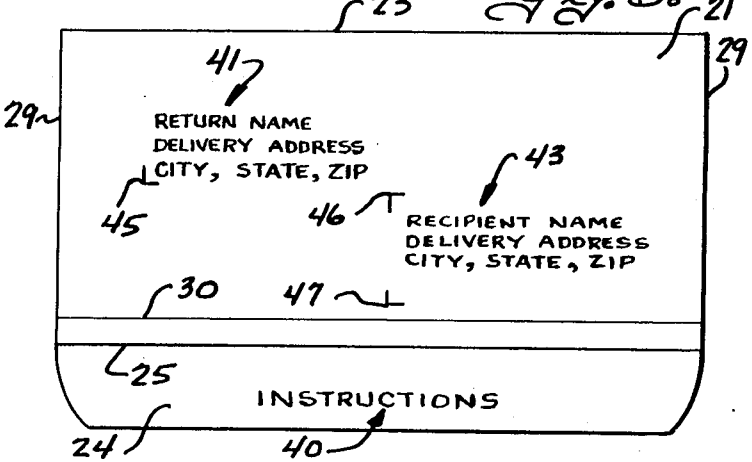
FIG. 6 is a front view of the re-mailable envelope of FIG. 5 with an OCR readable mailing address applied thereto.
Figure 5:
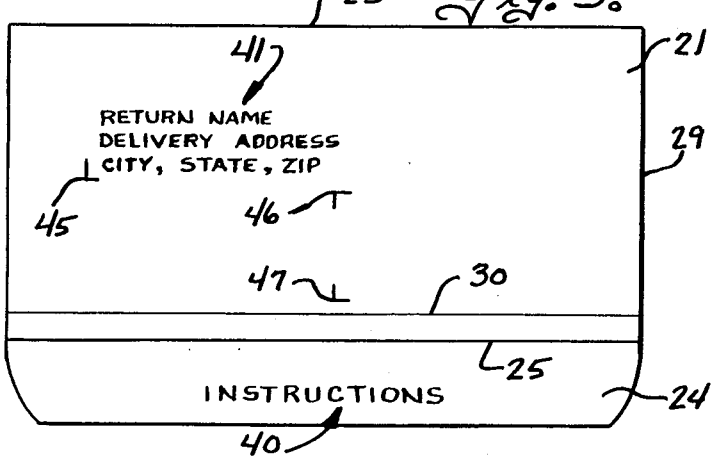
FIG. 5 is a front view of the re-mailable envelope of FIG. 3 with an OCR readable return address applied thereto.

Automated mail processing equipment of the U.S. Postal Service is presently capable of handling mail pieces between a minimum size of $3\frac{1}{4}''$ wide by $5''$ long and a maximum size of $6\frac{1}{8}''$ wide and $11\frac{1}{4}''$ long. The mailing envelope of the present invention can be of any size within the minimum and maximum sizes capable of being processed on automated mail handling equipment. The two-way mailing envelope is illustrated in the drawings on approximately one-half scale and is representative of a full size two-way mailing envelope having a width of about $4\frac{1}{4}''$ and a length of about $8\frac{1}{4}''$.

The two-way mailing envelope is formed from a single blank and includes a generally rectangular front panel 21 and a generally rectangular rear panel 22 integrally joined together at their upper side edges along a fold line 23. A first closure flap 24 is integrally joined to the lower side edge of the front panel 21 along a first flap fold line 25 and a second closure flap 26 is integrally joined to the lower side edge of the rear panel 22 along a second flap fold line 27. Edge flaps 28 are integrally joined to the end edges of one of the panels and preferably the front panel 21 along edge fold lines 29. The front and rear panels 21 and 22 and adapted to be folded along the fold line 23 with their inner sides in face-to-face contact and the end flaps 28 are adapted to be folded inwardly into overlying relation with the rear panel adjacent the end edges thereof. Adhesive 31 is provided on the inner face of the end flaps 28 and, when the front and rear flaps are folded into overlapping relation and the end flaps folded inwardly to overlie the rear panel, the end flaps are sealed to the outer face of the rear panel to form a pocket between the front and rear panels. Adhesive 32, preferably in discrete spots, is provided along the inner face of the first end flap 24 for sealing the first closure flap during the initial mailing, and adhesive 33, herein shown as a strip, is provided on the inner face of the second closure flap 26, for use in sealing the second closure flap during re-mailing.

Figure 8:
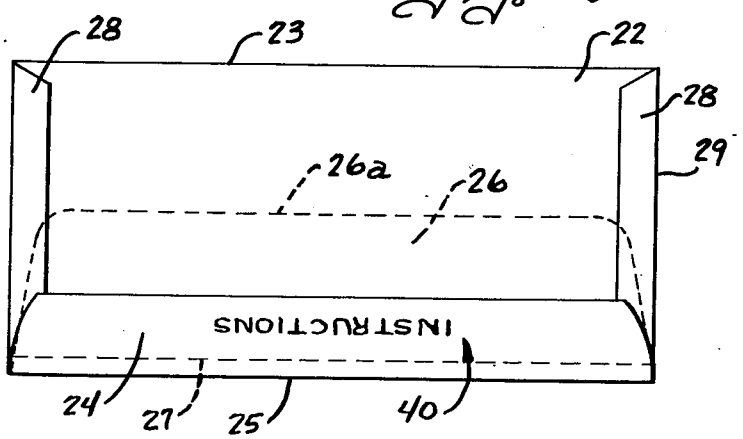
FIG. 8 is a rear view of the closed re-mailable envelope of FIG. 7.
Figure 10:
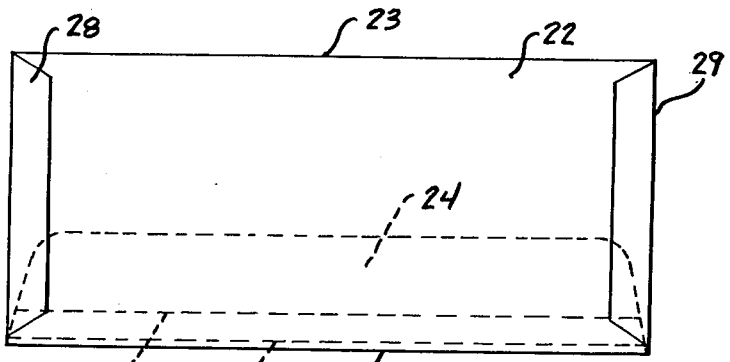
FIG. 10 is a rear view of the re-mailable envelope in a re-closed condition for return mailing.

During manufacture of the two-way envelope, the second closure flap 26 is folded along fold line 27 so that it lies in the pocket between the front and rear panels 21 and 22. The end edges of the second closure flap are preferably tapered as shown or otherwise shaped so as to be spaced inwardly from the end edges of the envelope pocket defined by end flap fold lines 29, to facilitate subsequent withdrawal of the flap 26 from the envelope pocket for return mailing. The height of the front panel 21, that is the distance between panel fold line 23 and the first flap fold line 25, is made greater than the height of the rear panel 22, that is the distance between the panel fold line 23 and the second flap fold line 27 so that the first flap fold line 25 is spaced below the second flap fold line 27 during the first mailing, as shown in FIG. 8.

The first closure flap 24 is adapted to be folded upwardly to overlap the rear panel to be sealed thereto by the adhesive 32 for the first mailing. When the envelope is received by the first mailing addressee, it is opened at the first closure flap to allow removal of the contents and withdrawal of the second closure flap 26 from the envelope pocket. To re-mail the envelope, the second closure flap 26 is withdrawn from the pocket between the front and rear panels and the second closure flap then folded along the second flap fold line 27 over the lower edge of the front panel 21 and into overlapping relation with the lower portion of the front panel. It is necessary to reduce the effective height of the front panel during re-mailing to a height no greater than, and preferably slightly less than the height of the rear panel in order to enable folding of the second closure flap into overlapping relation to the front panel. Accordingly, the front panel 21 has means defining a line 30 spaced from the panel fold line 23 a distance no greater than and preferably slightly less than the spacing of the second flap fold line 27 from the panel fold line 23. The line 30 can be a crease line to facilitate folding of the front panel therealong or a printed line to indicate the location of a fold line in the front panel, or a line of perforations to facilitate tearing of the front panel therealong.

Figure 7:
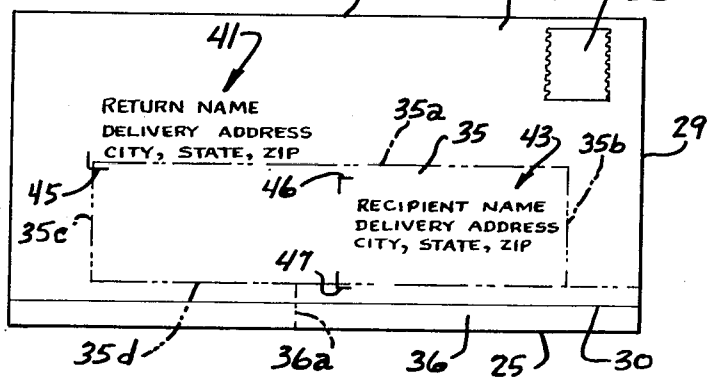
FIG. 7 is a front view of the re-mailable envelope in a closed condition with address and postage applied for a mailing.
Figure 9:
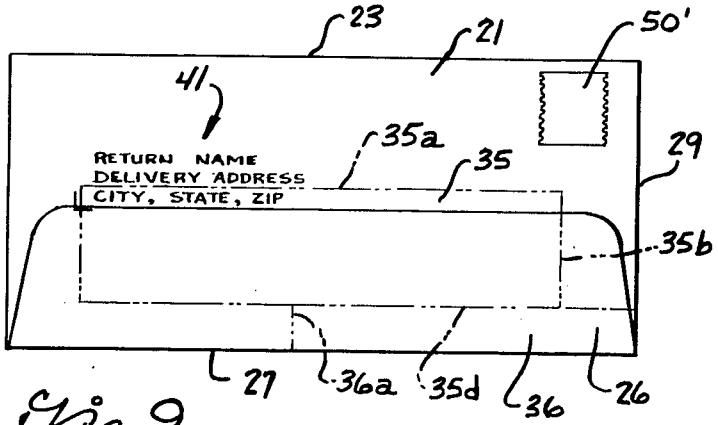
FIG. 9 is a front view of the re-mailable envelope in re-closed condition with postage applied for return mailing.

Present automatic mail processing equipment utilizes optical character readers which read at least portions of OCR readable mailing address indicia when located in a preselected mailing address read area on the front of the envelope. The mailing address read area 36 is indicated in FIGS. 7 and 9 by a solid line interrupted by a double dash and the present OCR mailing address read area delimited by the U.S. Postal Service has its upper read area limit 35*a* spaced $2\frac{1}{4}''$ above the lower edge of the envelope and its end edges 35*b*, 35*c* spaced inwardly 1" from the end edges of the envelope, and with its bottom edge 35*d* spaced above the lower edge of the envelope about $\frac{5}{8}''$ to provide a bar code read area 36 on the front side of the envelope below the mailing address read area 35. The present bar code read area delimited by the U.S. Postal Service has its upper limit spaced $\frac{5}{8}''$ from the lower edge of the envelope and a length of $4\frac{1}{4}''$ measured from the right edge of the envelope. In the embodiment illustrated, the left end of the bar code read area extends to a point indicated by line 36*a*. The optical character readers are adapted to read at least the zip code of the mailing address in the mailing address read area 35 and to print a bar code representing at least the zip code in the bar code read area 36. The bar code so printed is utilized in bar code sorters and the like for further automated processing of the mail.

Two-way mailing envelopes are commonly used by companies who mail out an invoice, statement, advertising or the like in the envelope during the initial mailing and which desire to have the envelope returned to the original mailer at a preselected return address. OCR readable return address indicia 41 are applied to the front panel of the envelope, as by printing directly on the front panel or by a printed label. The return address indicia generally includes an upper line containing the return name, an intermediate line containing the return delivery address such as the street address or post office box; and a lowermost line containing the city, state and zip code of the return address. The return address indicia is applied to the front panel with the indicia oriented to be right side up for visual and optical character reading when the envelope is oriented with the panel fold line at the top of the envelope. The return address is applied to the front panel at a location such that during the second or return mailing of the envelope, the lowermost line of the return address containing the city, state and zip code extends into the OCR mailing address read area 35 a short distance preferably about one-quarter of an inch below the upper mailing address read area limit 35*a*.

OCR readable mailing address indicia designated generally by the numeral 43 are provided on the front panel 21 of the envelope and by printing directly on the envelope or by a printed label. Alternatively, the envelope can be of the window type and mailing address indicia provided on an insert in the envelope positioned so that the mailing address can be read through the window. The mailing address indicia in general includes an upper line containing the recipient or mailing addressee's name; an intermediate line containing the recipient's delivery address such as the street address or box number, and a lowermost line containing the city, state and zip code number of the recipient. The mailing address indicia are provided on the front panel with the mailing address indicia oriented to be right side up for visual and optical character reading when the envelope is oriented with the panel fold line at the top of the envelope and the mailing address is located on the front panel so as to lie within the border of the OCR mailing address read area 35 during the first or initial mailing of the envelope. The address indicia are preferably located such that, when the front panel 21 is viewed with the panel fold line 23 at the top, the mailing address indicia 43 are offset toward the right hand portion of the OCR mailing address read area 35 and the return address indicia offset toward the left hand portion of the mailing address read area, with the upper line of the mailing address indicia at a level below the lowermost line of the return address indicia.

After the proper enclosures are inserted into the envelope pocket, the first closure flap 24 on the front panel is folded along the first flap fold line 25 upwardly and rearwardly into overlapping relation with the lower portion of the rear panel to close the envelope as shown in FIGS. 7 and 8. Postage 50 is affixed to the front panel at a location above the OCR read area for the first mailing. The envelope can be processed during the initial or first mailing by automatic mail processing equipment having optical character readers adapted to read at least a portion of the mailing address indicia in the OCR read area 35 and to print a bar code in the bar code read area 36 representing at least a portion such as the zip code of the mailing address indicia. The first flap fold line 25 defines the lower edge of the envelope during the first mailing and the OCR read area and bar code read area of the automatic mail processing machines is measured from the fold line 25 during automatic processing of the envelope in the course of the first mailing to the mailing addressee.

When the two-way envelope is received by the mailing addressee, it is opened at the first closure flap and the enclosures removed. As previously described, the first flap fold line 25 is spaced from the panel fold line 23 a distance greater than the spacing of the second flap fold line from the flap fold line 23 so that the second flap fold line 27 is spaced upwardly from the flap fold line 25 during the first mailing as shown in FIG. 8. The first flap 24 can be opened in any manner which does not cut or damage the second flap, and may, for example, be opened by lifting the first flap in a manner to rupture the seals at adhesive spots 32. The first flap can also be opened by a letter opener along the first flap fold line 25 or by cutting a narrow strip off along the lower edge of the envelope, with the strip having a width less than the spacing between fold lines 25 and 27. In remailing the two-way envelope, the second closure flap is removed from the pocket between the front and rear panels 21, 22 and, after insertion of the proper return enclosures, the envelope is re-closed and sealed with the second closure flap. The second flap fold line 27 is spaced from the panel fold line 23 a distance less than the height of the front panel measured between panel fold line 23 and first flap fold line 25, and it is necessary to reduce the effective height of the front panel to less than the height of the rear panel. For this purpose, the front panel can be folded along line 30 if the line is a crease or printed line, or the front panel can be torn along line 30 if it is in the form of a line of perforations. Line 30 is spaced from the panel fold line 23 a distance slightly less than the spacing of the second flap fold line 27 from panel fold line 23 so that, when the front panel is either folded or torn off along line 30, the effective height of the first panel is reduced sufficient to allow folding of the second closure flap over the lower portion of the front panel.

The envelope is closed for re-mailing by folding the second closure flap upwardly along flap fold line 27 into overlapping relation with the lower portion of the front panel, and sealing the second closure flap to the front panel by adhesive 33. Postage 50' for the second mailing is applied to the front panel, preferably covering the postage 50 for the first mailing. The second closure flap is dimensioned so that it will cover the first mailing address indicia 43 and also any bar code that was applied in the bar code read area 36 on the front panel 21 during the initial mailing, but allows the entire return address including the last line of the return address indicia 41 to remain exposed. For this purpose, the second closure flap has an upper edge portion **26*a* which extends from the lower flap fold line 27 a distance less than the spacing of the upper read area limit 35*a* and such that the last line of the return address indicia that extends into OCR read area 35, is above the upper edge 26*a* of the second flap 26 and remains exposed when the second closure flap is sealed to the front of the envelope. The height of the second closure flap measured between second flap fold line 27 and the edge 26*a* of flap 26 is made less than the upper read area limit 35*a* of the OCR read area and, preferably, the second closure flap has a height of about two inches so that the upper edge 26*a* is spaced about one quarter inch below the proper read area limit during the second or return mailing of the two-way envelope. The height of the first closure flap measured from flap fold line 25 plus the distance between fold line 25 and line 30** is preferably made substantially less than the height of the second closure flap so that it is not necessary to remove the first closure flap in order to close and seal the second closure flap. Thus, during reclosing of the envelope, the first closure flap can be folded upwardly across the lower portion of the front panel and the second closure flap then folded up over the first closure flap and sealed to the front panel at a level above the first closure flap.

The second flap fold line 27 defines the lower edge of the envelope during the second or return mailing and, as previously described, the second flap fold line is spaced below the upper panel fold line 23 a distance less than the spacing of the first flap fold line from the panel fold line. Thus, during the second or return mailing, the return address indicia on the front of the envelope are in effect shifted downwardly and extend deeper into the OCR read area during the second mailing than during the first mailing. This aids in assuring proper reading of the lowermost line of the return address indicia by the OCR readers of automatic mail processing equipment during the second mailing. The height of the rear panel measured between panel fold line 23 and second flap fold line 27 may advantageously be made shorter than the height of the front panel measured between the panel fold line and first flap fold line 25, by an amount corresponding to the height of the lowermost line of the return address indicia, for example one-quarter inch or more. This difference in height between the front and rear panels is illustrated in FIG. 8 by the spacing between the first and second flap fold lines 25 and 27. Since the return address indicia 41 on the front panel are effectively shifted downwardly relative to the OCR read area during return mailing, the lowermost line of the return address could be located on the front panel such that it lies wholly within the OCR read area during the second mailing, even if it is partially or even wholly above the OCR read area during the second mailing. For example, if the height of the lowermost line of the return address is about one-quarter inch and the rear panel is about one-quarter inch shorter than the front panel, the last line of the return address on the front panel could lie above the upper read area limit **35*a* during the first mailing as shown in FIG. 7, and still shift down into OCR read area during return mailing as shown in FIG. 9**. This aids in assuring reliable reading of the return address by OCR readers during the second mailing without excessive projection of the return address into the OCR mailing address read area during the first mailing. The mailing address on the front panel is also in effect shifted downwardly relative to the OCR read area during return mailing and this facilitates covering of the mailing address for the second mailing with a second closure flap having a height less than the height of the upper read area limit. For example, if the mailing address were located on the front panel such that the upper line of the mailing address was immediately below the two and one-quarter inch upper read area limit during the first mailing, the second closure flap having a height of two inches could still cover the entire mailing address if the rear panel was one-quarter inch shorter than the front panel.

In the two-way mailing envelope and the method of making and addressing the same disclosed, the return address used during the first mailing can also function as the re-mailing address and it is accordingly unnecessary to provide a re-mailing address on the second closure flap for return mailing. The two-way envelope can be manufactured with the second closure flap inserted into the pocket between the front and rear panels, before any printing on the envelope. The return addresses can be printed on the envelope after the envelopes are folded and without requiring elaborate equipment. Instructions for opening and returning as indicated at 40 can be provided on the first closure flap or on the rear panel of the envelope, if desired. For example, the instructions can be as follows: "This is a returnable envelope. Open flap carefully and use inside flap to return remittance. Place postage stamp at top right for returning." A means such as angle markers 45 are advantageously provided on the front panel to denote the lower-left limit for the last line of the return address indicia, and a means such as angle markers 46 and 47 provided to denote the upper-left and lower-left limits respectively of the mailing address indicia.

From the foregoing it is thought that the manner of making and using the two-way mailing envelopes will be readily understood. The envelope and the return and mailing address indicia are so arranged that the second closure flap can be relatively short and have a height only sufficient to cover the original mailing address and any bar code printed on the front of the envelope during the first mailing. This short second closure flap not only reduces the amount of material required for making the envelope but also facilitates withdrawal of the second closure flap from the envelope pocket for re-mailing. The second closure flap is arranged in relation to the mailing address indicia so that during re-mailing it covers the original mailing address and any bar code on the front panel of the envelope. The entire return address 41 including the lowermost line containing the city, state and zip, lie above the upper edge **26*a*** of the second closure flap during the second mailing, for reading by OCR readers. The two-way envelope has the additional advantage that it eliminates the necessity of printing a remailing address on the second closure flap and instead utilizes the original return address while yet allowing the envelope to be processed by automatic mail processing equipment during the return mailing.

The embodiments of the invention in which an exclusive property or privilege is claimed are defined as follows:

1. A two-way mailing envelope adapted for either manual or automatic processing by mail processing machinery having optical character readers which can read address indicia in a preset OCR mailing address read area delimited by the U.S. Postal Service on the front of the envelope and print a bar code on a bar code read area on the front of the envelope below the preset OCR mailing address read area, the mailing address read area having an upper read area limit spaced a preset height above the lower edge of the envelope, the upper read area limit being spaced below the upper edge of the envelope to provide an upper area on the front of the envelope for a return address and for postage, the two-way mailing envelope being formed from a single elongated blank comprising a generally rectangular front panel having upper and lower side edges and end edges extending between its side edges and a generally rectangular rear panel having upper and lower side edges and end edges extending between its side edges, the front and rear panels being integrally joined at their upper side edges along a panel fold line, a first closure flap integrally joined to the lower side edge of the front panel along a first flap fold line, a second closure flap integrally joined to the lower side edge of the rear panel along a second flap fold line, end flap means connecting the front and rear panels together along their end edges to form a pocket, the second closure flap being initially folded along the second flap fold line relative to the rear panel and inserted into the envelope pocket between the front and rear panels, the first closure flap being adapted to be folded along the first fold line relative to the front panel upwardly into overlapping relation with a lower portion of the rear panel and having first flap seal means for sealing the first closure flap to the rear panel for a first mailing of the envelope, the first flap fold line being spaced a first distance below the panel fold line and defining a first envelope lower edge during the first mailing, the second closure flap being removable from the envelope pocket after the envelope is opened and the second closure flap being adapted to be folded along the second flap fold line relative to the rear panel upwardly into overlapping relation with a lower portion of the front panel and having second flap seal means for sealing the second closure flap to the front panel of the envelope for a return mailing of the envelope, the second flap fold line being spaced below the panel fold line a second distance less than said first distance and defining a second envelope lower edge during said return mailing, the second closure flap having a free upper edge and being shaped and dimensioned such that, when folded upwardly along the second flap fold line into overlapping relation to the lower portion of the front panel for the return mailing, at least a portion of said free upper edge is spaced above the second flap fold line a distance less than said preset height of the upper read area limit of said preset OCR mailing address read area, printed OCR readable return address indicia on the front panel oriented to be right side up for visual and optical character reading when the envelope is oriented with the panel fold line at the top of the envelope, the return address indicia including a lowermost line containing the city, state and zip code of the return address at a location to be below the upper read area limit of said preset OCR mailing address read area and above said portion of the free upper edge of the second closure flap when the latter is folded upwardly along the second flap fold line into overlapping relation with the lower portion of the front panel for the second mailing, the return address indicia also including a return name and return delivery address in lines located above the upper read area limit of the preset OCR mailing address read area, the front panel having printed OCR readable mailing address indicia in said preset OCR mailing address read area and oriented to be right side up for visual and optical character reading when the envelope is oriented with the panel fold line at the top of the envelope, the mailing address indicia including at least the mailing addressee's name, delivery address and city, state and zip code, with the city, state and zip code in the lowermost line of the mailing address, and the second closure flap being shaped and dimensioned such that, when folded upwardly along the second flap fold line into overlapping relation to the lower portion of the front panel for the second mailing, it covers the bar code read ara on the front panel and all of the mailing address indicia in the preset OCR read area on the front panel but has said portion of the free upper edge of the second closure flap disposed below the lowermost line of the return address indicia whereby all of the return address indicia remains exposed for use in manual or automatic processing during the second mailing.

2. A two-way mailing envelope according to claim 1 wherein the upper read area limit of the preset OCR mailing address read area is two and one-quarter inches above the lower edge of the envelope and said portion of the free upper edge of the second closure flap is spaced not more than two inches above the second flap fold line when the second closure flap is folded upwardly in overlapping relation with the lower portion of the front panel for the second mailing.

3. A two-way mailing envelope according to claim 1 wherein the front panel has means defining a line spaced below said panel fold line a distance no greater than said second distance to facilitate reducing of the effective height of the front panel when the second closure flap is folded along the second flap fold line upwardly into overlapping relation with said lower portion of the front panel for return mailing.

4. A two-way mailing envelope according to claim 3 wherein said means defining a line in the front panel comprises a crease line in the front panel.

5. A two-way mailing envelope according to claim 3 wherein said means defining a line in said front panel is a line of perforations.

6. A two-way mailing envelope according to claim 3 wherein said means defining a line in said front panel is a printed line.

7. A two-way mailing envelope according to claim 1 wherein the lowermost line of the return address is spaced above the first flap fold line a distance such that it lies at least partially above the upper read area limit of the preset OCR mailing address read area during the first mailing of the envelope.

8. A method of making and addressing a two-way mailing envelope adapted for either manual or automatic processing by mail processing machinery having optical character readers which can read address indicia in a preset OCR mailing address read area delimited by the U.S. Postal Service on the front of the envelope and print a bar code on a bar code read area on the front of the envelope below the preset OCR mailing address read area, the mailing address read area having an upper read area limit spaced a preset height above the lower edge of the envelope, the upper read area limit being spaced below the upper edge of the envlope to provide an upper area on the front of the envelope for a return address and for postage, (a) providing a two-way mailing envelope having a generally rectangular front panel with upper and lower side edges and end edges extending between its side edges and a generally rectangular rear panel having upper and lower side edges and end edges extending between its side edges, the front and rear panels being integrally joined at their upper side edges along a panel fold line, a first closure flap integrally joined to the lower side edge of the front panel along a first flap fold line, a second closure flap integrally joined to the lower side edge of the rear panel along a second flap fold line, and end flaps connecting the front and rear panels together along their end edges to form a pocket, the second closure flap being initially folded along the second flap fold line relative to the rear panel and inserted into the envelope pocket between the front and rear panels, the first closure flap being adapted to be folded along the first flap fold line relative to the front panel upwardly into overlapping relation with a lower portion of the rear panel and having first flap seal means for sealing the first closure flap to the rear panel for a first mailing of the envelope, the first flap fold line being spaced a first distance below the panel fold line and defining the lower edge of the envelope during the first mailing, the second closure flap being removable from the envelope pocket after the envelope is opened and the second closure flap being adapted to be folded along the second flap fold line relative to the rear panel upwardly into overlapping relation with a lower portion of the front panel and having second flap seal means for sealing the second closure flap to the front panel of the envelope for a second mailing of the envelope, the second flap fold line being spaced below the panel fold line a second distance less than said first distance and defining the lower edge of the envelope during said second mailing, the second closure flap having a free upper edge and being shaped and dimensioned such that, when folded upwardly along the second flap fold line into overlapping relation to the lower portion of the front panel for the second mailing, at least a portion of said free upper edge is spaced above the second flap fold line a distance less than said preset height of the upper read area limit of said preset OCR mailing address read area, (b) applying a printed OCR readable return address indicia on the front panel prior to the first mailing oriented to be right side up for visual and optical character reading when the envelope is oriented with the panel fold line at the top of the envelope, the return address indicia including a lowermost line containing the city, state and zip code of the return address at a location to be below the upper read area limit of said preset OCR mailing address read area and above said portion of the free upper edge of the second closure flap when the latter is folded upwardly along the second flap fold line into overlapping relation with the lower portion of the front panel for the second mailing, the return address indicia also including a return name and return delivery address in lines located above the upper read area limit of the preset OCR mailing address read area, (c) applying a printed OCR readable mailing address indicia on the front panel prior to the first mailing in said prest OCR mailing address read area and oriented to be right side up for visual and optical character reading when the envelope is oriented with the panel fold line at the top of the envelope, the mailing address indicia including at least the mailing addressee's name, delivery address and city, state and zip code, with the city, state and zip code in the lowermost line of the mailing address, and the second closure flap being shaped and dimensioned such that, when folded upwardly along the second flap fold line into overlapping relation to the lower portion of the front panel for the second mailing, it covers the bar code read area on the front panel and all of the mailing address indicia in the preset OCR read area on the front panel but has said portion of the free upper edge of the second closure flap disposed below the lowermost line of the return address indicia whereby all of the return address indicia remains exposed for use in manual or automatic processing during the second mailing.

9. A method of making and addressing a two-way mailing envelope according to claim 8 wherein the upper read area limit of the preset OCR mailing address read area is two and one-quarter inches above the lower edge of the envelope and said portion of the free upper edge of the second closure flap is spaced no more than two inches above the second flap fold line when the second closure flap is folded upwardly into overlapping relation with the lower portion of the front panel for the second mailing.

10. A method of making and addressing a two-way mailing envelope according to claim 8 including providing a line on the front panel spaced below the panel fold line a distance less than said second distance to facilitate reducing the effective height of the front panel when the second closure flap is folded along the second flap fold line upwardly into overlapping relation with said lower portion of the front panel for return mailing.

11. A method of making and addressing a two-way mailing envelope according to claim 8 wherein the lowermost line of the return address is spaced above the first flap fold line a distance such that it lies at least partially above the upper read area limit of the preset OCR mailing address read area during the first mailing of the envelope.

* * * * *